US005577296A

United States Patent [19]

Grass

[11] Patent Number: 5,577,296

[45] Date of Patent: Nov. 26, 1996

[54] DOOR HINGE WITH SNAP-IN LOCKING DEVICE FOR QUICK ASSEMBLY

[75] Inventor: Alfred Grass, Höchst/Vlbg, Austria

[73] Assignee: Grass AG, Hochst/Vlgb, Austria

[21] Appl. No.: 482,960

[22] Filed: Jun. 15, 1995

Related U.S. Application Data

[63] Continuation of Ser. No. 139,207, Oct. 19, 1993, abandoned.

[51] Int. Cl.[6] ..... E05D 7/12

[52] U.S. Cl. ..... 16/258; 16/382

[58] Field of Search ..... 16/252, 257, 258, 16/260, 261, 382, DIG. 43, 259, 270

[56] References Cited

U.S. PATENT DOCUMENTS

| | | | |
|---|---|---|---|
| 863,221 | 8/1907 | Rice | 16/258 |
| 4,547,930 | 10/1985 | King et al. | 16/247 |
| 4,691,408 | 9/1987 | Röck et al. | 16/382 |
| 4,881,297 | 11/1989 | Grass | 16/258 |
| 5,058,237 | 10/1991 | Mahr | 16/382 |
| 5,088,155 | 2/1992 | Grass | 16/257 |
| 5,159,740 | 11/1992 | Brüstle et al. | 16/DIG. 43 |

*Primary Examiner*—M. Rachuba
*Assistant Examiner*—Kenneth J. Hansen
*Attorney, Agent, or Firm*—Petree Stockton LLP

[57] ABSTRACT

A single articulation door hinge includes a base plate and a one-piece hinge arm. The base plate and hinge arm are quickly disconnected by a snap-in locking device to allow easy removal of a door from a cabinet frame, for example. The catch spring includes two substantially parallel sides releasably engageable with the base plate with one side having a catch shank and the other second side having a nose disposed toward one another. The catch spring further includes a scroll spring disposed between the shank and nose, biased toward the nose to engage and secure the catch spring against the hinge arm.

8 Claims, 5 Drawing Sheets

DOOR HINGE WITH SNAP-IN LOCKING DEVICE FOR QUICK ASSEMBLY

Figure 1:
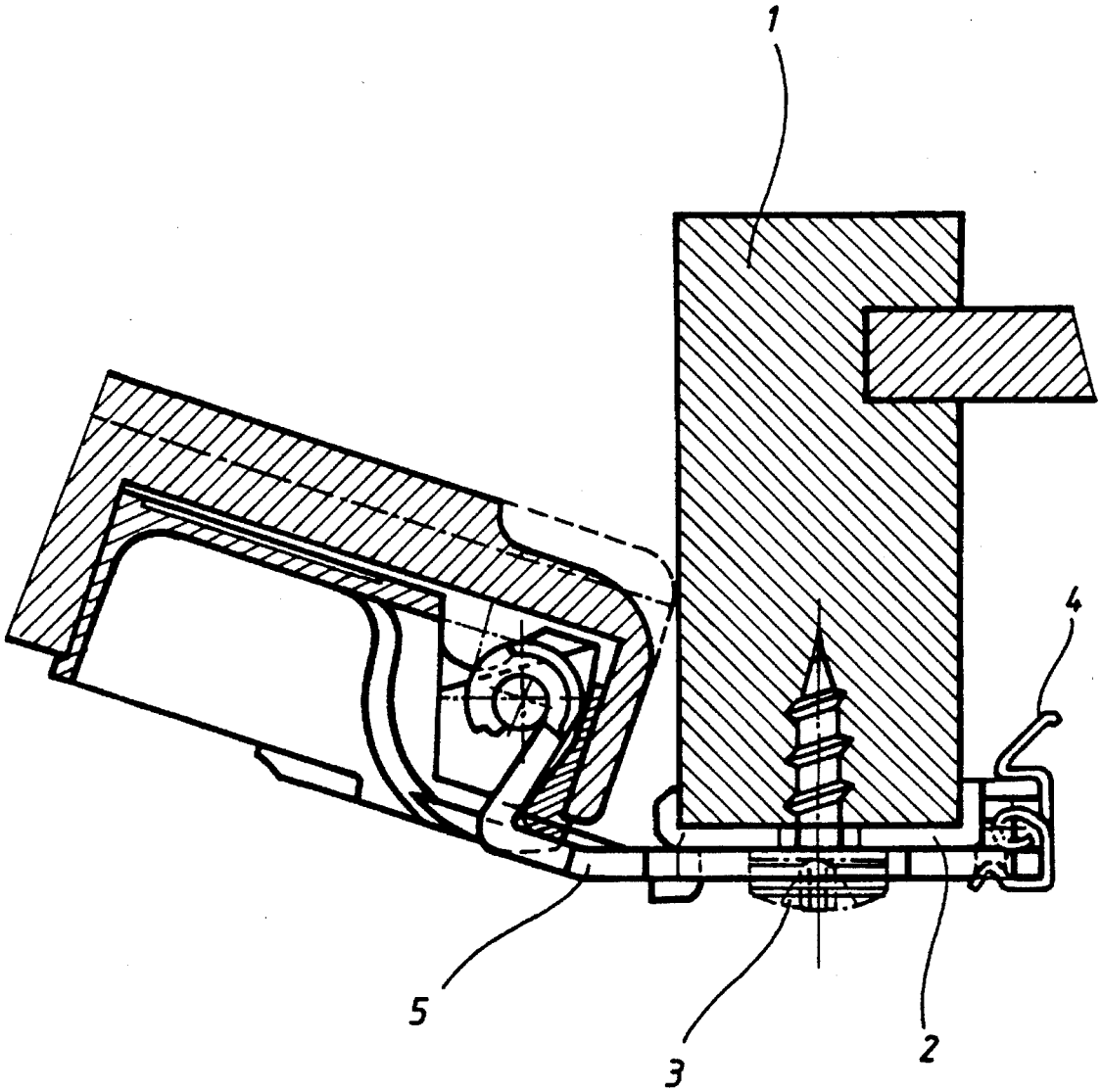

This application is a continuation of application Ser. No. 08/139,207 filed on Oct. 19, 1993 now abandoned.

The purpose of the invention concerns a door hinge with snap-in locking device for quick assembly, consisting of a base plate which is fastened to the cabinet and a hinge arm which is fastened to the door wing.

A door hinge of the indicated type is demonstrated, for example, by the patent document U.S. Pat. No. 5,088,155; whereby, here, a snap-in locking device engages between a base plate (4) and a separate distance plate (7). By the utilization of a distance plate, a relatively large build-up in height results, and the mounting device projects relatively far into the diaphragm opening of the cabinet.

The purpose of the invention is to further develop the type of door hinge mentioned before, because a quick assembly of the hinge is possible and because a slight build-up of the height of the fastening method only minimally projects in the diaphragm opening of the cabinet.

To solve these problems, the invention; thereby marked, has the hinge arm in the center of a catch spring which is solidly fastened and yet always detachable.

After the base plate is screwed on to the cabinet, the door leaf can be fastened thereon in a simple manner. The hinge arm is mounted to the door leaf with help of the snap-in locking device, which is attached without tools to the base plate and which is always removable.

In a preferred design form, the snap-in locking device's end inserts a catch shank, that engages a corresponding shank and is fixed there; whereby, a nose is on the other end of the snap-in locking device, that engages in a corresponding catch opening on the hinge arm so that a tight connection results between the base plate and the hinge arm.

This results in a very simple assembly; whereby, through the direct connection of the hinge arm to the base plate, a very slight build-up in height is attained and the total device projects only minimally into the diaphragm opening of the cabinet body.

A necessary load moment to connect the fastening is achieved when one hangs the hinge arm in the suitable open position in the interlocking hooks of the base plate. A stop cam takes care of a simple positioning of the device.

The corresponding scroll spring on the catch spring ensures a tight connection of the catch spring and hinge arm.

Furthermore, the catch spring engages a lever arm that makes a simple method of releasing the connection between the hinge arm and the base plate possible. This lever arm is located on the backside of the frame, so that an erroneous application can be prevented.

The invention is not, however, limited to the preceding descriptive and preferred design embodiment, but instead, it can be utilized, also much more in other ways, styles and forms (for instance, for the catch springs).

For instance, corresponding catch openings can be provided on the base plate, as well as on the hinge arm. Furthermore, for example, another scroll spring exerts corresponding counter pressure on the lever arm of the base plate.

The innovative basis of the submitted invention results from not only the matter of the individual patent claims, but also the various combinations of the individual patent claims.

All records, documents, and evidence, inclusive of the summary, open and disclosed statements, declarations, indications and features, especially those represented embodiments in the drawings, will be claimed as fundamental and significant to the invention, as far as the claims, individually or in combinations, are relative to the position that the technology is new.

The invention will be explained more precisely in the following detailed design examples, from which additional important features follow.

Figure 2:
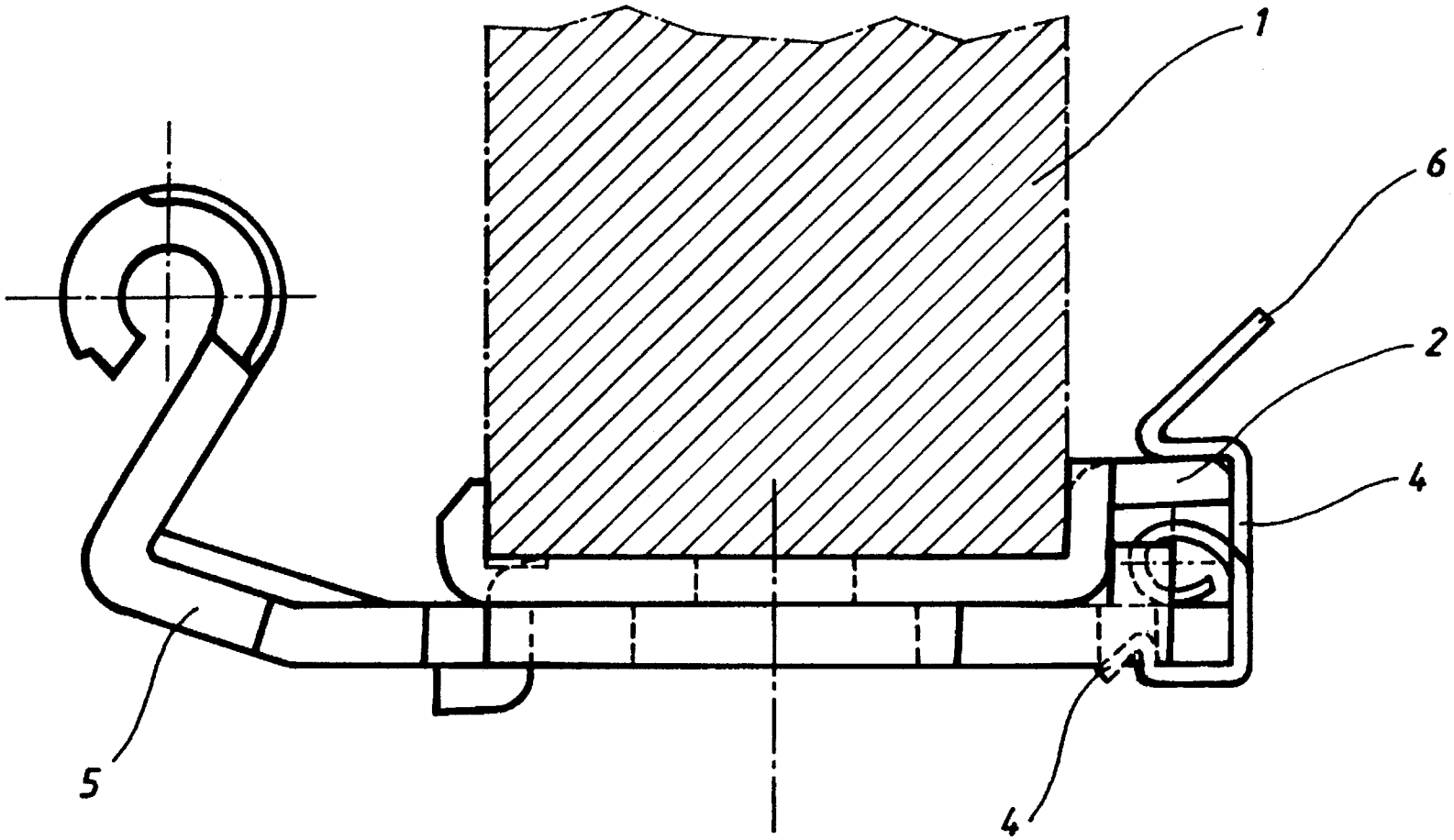
Figure 3:
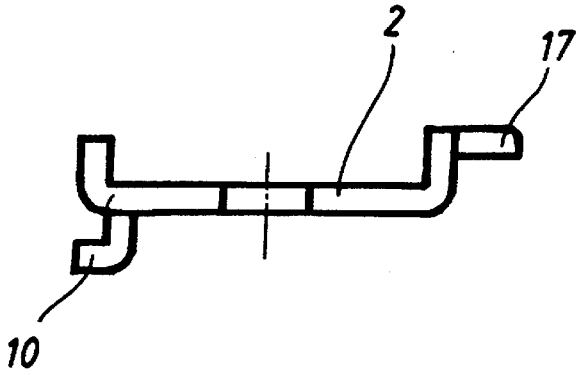
Figure 4:
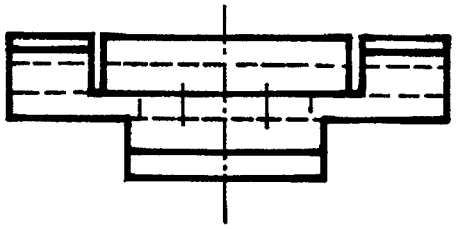
Figure 5:
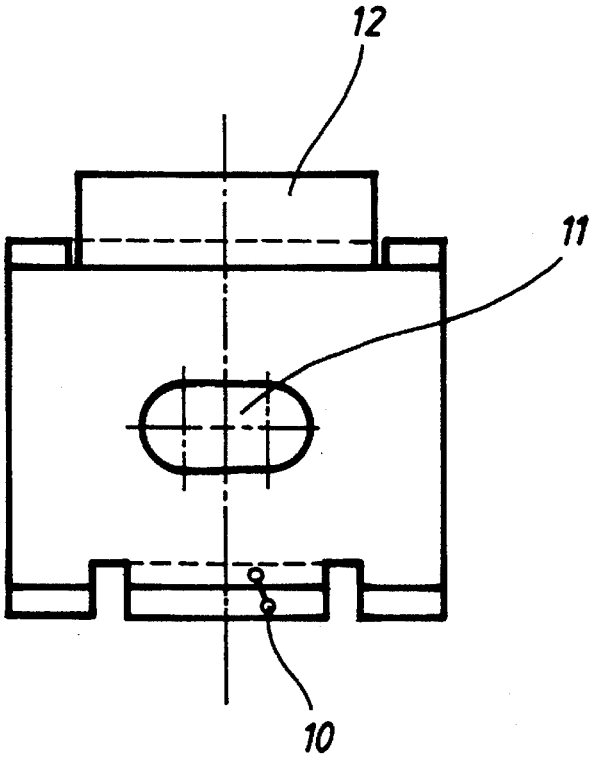
Figure 6:
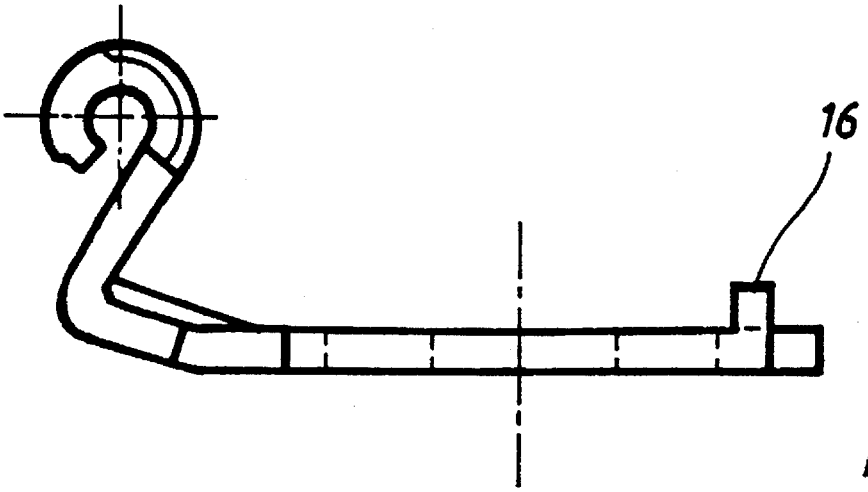
Figure 7:
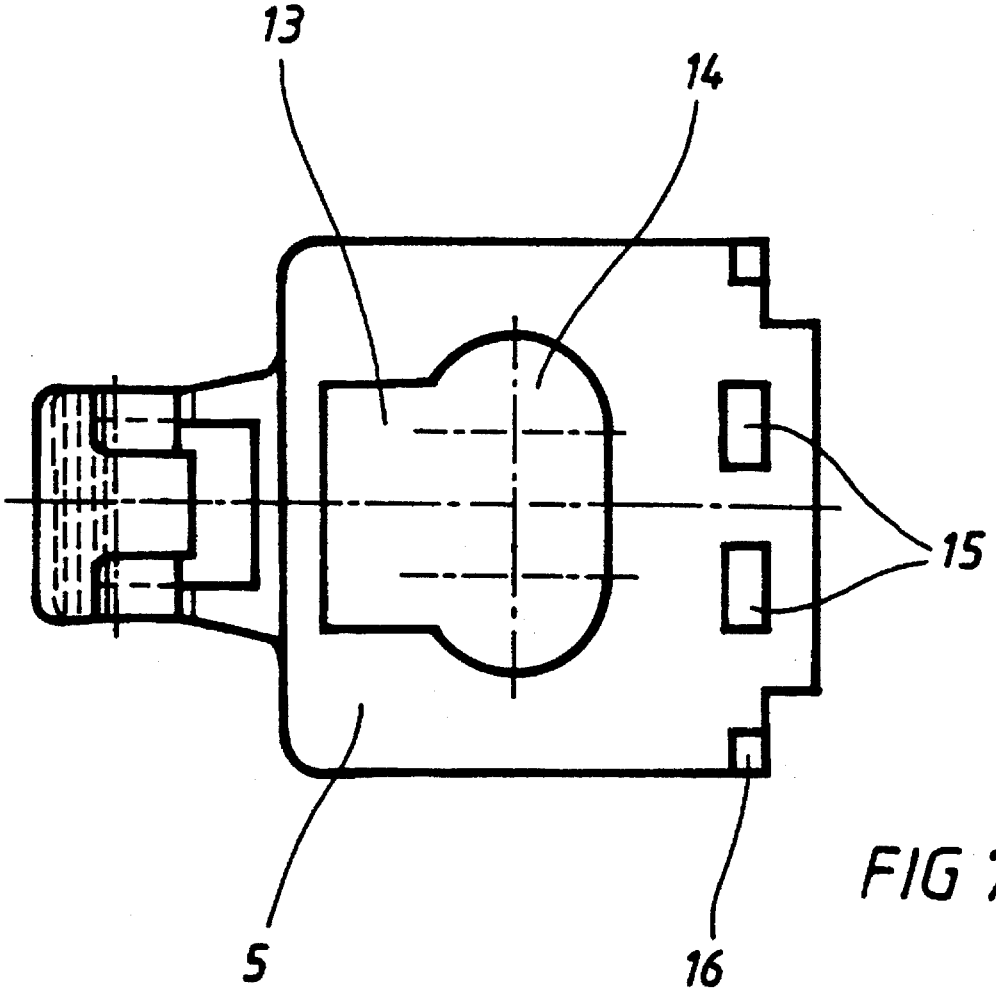
Figure 8:
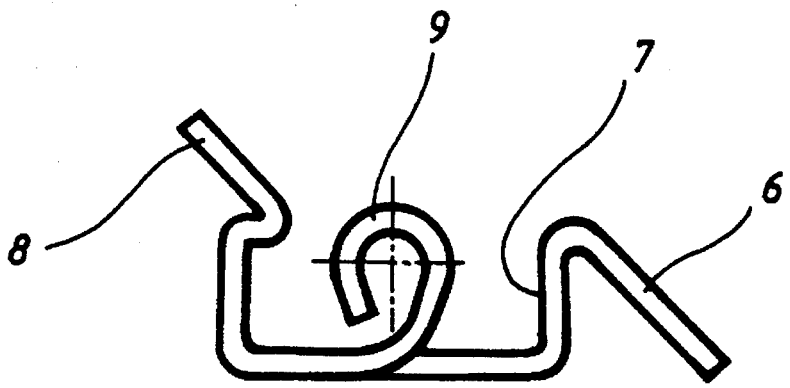
Figure 9:
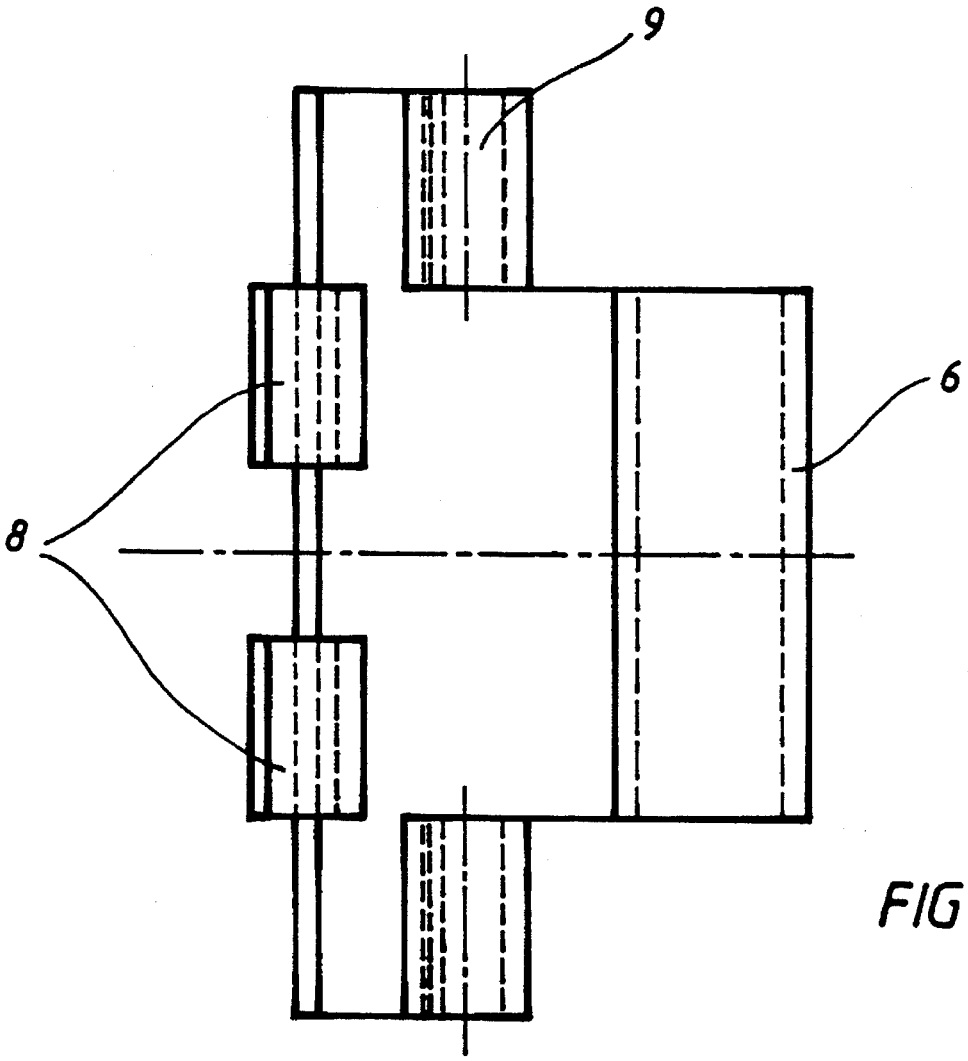

Indicated:

FIG. 1: a section through the door hinge as seen from above, with respective fasteners on the door wing and on the cabinet;

FIG. 2: a section of the door hinge, as seen from above;

FIG. 3: a side view of the base plate;

FIG. 4: a front view of the base plate;

FIG. 5: a top view of the base plate;

FIG. 6: a side view of the hinge arm:

FIG. 7: a top view of the hinge arm;

FIG. 8: a side view of the catch spring;

FIG. 9: a top view of the catch spring,

The base plate (2), according to FIGS. 3–5, inserts an elongated hole (11) shaped bore hole, which can be fastened with the base plate (2) on the front face of the cabinet (1).

Hereby, the screw (3), for instance, reaches through the elongated hole (11) (comparison FIG. 1), into the base plate, so that the base plate (2) can be shifted and fixed perpendicular to the plane of projection of FIG. 1 to the cabinet.

After the base plate (2) is mounted, the hinge arm (5) with a provided open position (13) (comparison FIG. 7) will be hanged from the front in one of the base plates (2) mounted interlocking hooks (10); whereby, the base plate (2) on the hinge arm (5) stop cams (16) guarantee the exact positioning the the hinge arm (5). This holds the hinge arm (5) in the correct place.

Furthermore, the hinge arm (5) produces an open place (14) for the head of the screw (3), so that direct contact between hinge arm (5) and base plate (2) is guaranteed.

The hinge arm (5) now lies in the correct location on the base plate (2), so these are connected together by means of catch spring (4). A preferred means of conformation of the catch spring (4) is derived from FIGS. 8 and 9. On one side the catch spring (4) inserts the catch shank (7), that engages a support shank (12) of the base plate (2). On the other side, the catch spring (4) finds the nose (8), that engages in the catch opening (15) of the hinge arm (5).

Due to the fitted scroll spring (9) on the catch spring (4), counter pressure is generated to the nose (8), so that a tight connection results between catch spring (4) and hinge arm (5).

A bent extension of the catch shank (7) results in lever arm's (6) detachability with catch spring (4) and thereby, the connection between base plate (2) and hinge arm (5).

I claim:

1. A single-articulation door hinge for supporting a door wing on a cabinet frame comprising: a base plate fastenable to the cabinet frame and having a top surface; a hinge arm fastenable to the door wing and having a bottom surface, the hinge arm having portions defining a catch opening; means for detachably connecting the hinge arm to the base plate with the hinge arm bottom surface and the base plate top surface in direct surface-to-surface contact, the connecting means comprising a catch spring having first and second depending and substantially parallel sides releasably engageable with the base plate and the hinge arm between the first and second depending and substantially parallel sides, the catch spring first side including a catch shank and the catch spring second side having a nose, the catch shank and nose disposed toward each other, the catch shank engaging a support shank of the base plate, and the nose engaging the catch opening of the hinge arm, and the catch shank and the nose of the catch shank exerting a resilient clamping pressure on the hinge arm and the base plate directly between the catch shank and the nose, the catch shank and nose of the catch spring being resiliently deflectable away from each other to release the clamping pressure therebetween and detach the hinge arm from the base plate, the catch spring also including a scroll spring disposed between the catch shank and the nose of the catch spring, the scroll spring biased toward the nose of the catch spring to engage and secure the catch spring against the hinge arm bottom surface.

2. The door hinge according to claim 1, wherein said catch spring includes a lever arm for releasing the catch spring.

3. The door hinge according to claim 1, said hinge arm having portions defining a hook opening, and said connecting means further comprising an interlocking hook extending from said base plate and enagageable in the hook opening.

4. The door hinge according to claim 1, further comprising a stop cam extending from said hinge arm and fitting against said base plate for positioning the hinge arm on the base plate.

5. The door hinge according to claim 1, wherein said catch spring includes a lever arm for releasing the catch spring.

6. The door hinge according to claim 1, wherein said catch spring has a portion connecting said catch shank and said nose of the catch spring, and said scroll spring is bent from said connecting portion between the catch shank and the nose of the catch spring.

7. A single-articulation door hinge for supporting a door wing on a cabinet frame comprising: a base plate fastenable to the cabinet frame and having a flat top surface; a support shank extending from the base plate; a hinge arm fastenable to the door wing and having a flat bottom surface, the hinge arm having portions defining a catch opening; means for detachably connecting the hinge arm to the base plate with the hinge arm flat bottom surface and the base plate flat top surface in direct surface-to-surface contact, the connecting means comprising a catch spring having first and second depending and substantially parallel sides releasably engageable with the base plate and the hinge arm between the first and second depending and substantially parallel sides, the catch spring first side including a catch shank and the second side having a nose, the catch shank and nose disposed toward each other, the catch shank engaging the support shank of the base plate, the nose engaging in the catch opening of the hinge arm, and the catch shank and the nose of the catch shank exerting a resilient clamping pressure on the hinge arm and the base plate directly between the catch shank and the nose urging the hinge arm flat bottom surface against the base plate flat top surface, the catch shank and nose of the catch spring being resiliently deflectable away from each other to release the clamping pressure therebetween and detach the hinge arm from the base plate, the catch spring also including a scroll spring disposed between the catch shank and the nose of the catch spring, the scroll spring biased toward the nose of the catch spring to engage and secure the catch spring against the hinge arm bottom surface.

8. The hinge as claimed in claim 7 wherein the hinge arm is one piece.

* * * * *